United States Patent [19]

Olt, Jr. et al.

[11] 4,052,910

[45] Oct. 11, 1977

[54] GOVERNOR AND DECELERATOR CONTROL LINKAGE

[75] Inventors: Arthur E. Olt, Jr., Pekin; Richard Vanrossem, Canton, both of Ill.

[73] Assignee: Caterpillar Tractor Co., Peoria, Ill.

[21] Appl. No.: 716,845

[22] Filed: Aug. 23, 1976

[51] Int. Cl.[2] ..... G05G 1/14; G05G 11/00

[52] U.S. Cl. ..... 74/482; 74/470; 192/8 R

[58] Field of Search ..... 74/470, 481, 482, 513; 192/8 R

[56] References Cited

U.S. PATENT DOCUMENTS

| | | | |
|---|---|---|---|
| 2,583,428 | 1/1952 | Houplain | 192/8 R |
| 2,617,396 | 11/1952 | Ervin, Jr. | 123/103 |
| 2,945,547 | 7/1960 | Bunker | 180/82.1 |
| 2,968,193 | 1/1961 | Frick | 74/472 |
| 3,002,397 | 10/1961 | du Shane et al. | 74/482 |
| 3,508,454 | 4/1970 | Fanslow et al. | 74/482 |
| 3,535,951 | 10/1970 | Larson et al. | 74/482 |
| 3,640,258 | 2/1972 | Isobe et al. | 123/140 FG |

*Primary Examiner*—Allan D. Herrmann
*Attorney, Agent, or Firm*—Phillips, Moore, Weissenberger, Lempio & Majestic

[57] ABSTRACT

A governor and control linkage having a first manually operated actuator provides for setting of a shaft and a control arm at a particular operating position through a coupling. The coupling locks the shaft in the aforedescribed desired position while allowing a second actuator to temporarily reposition the control arm at any intermediate setting without disturbing the manual setting. A resilient member is included to return the control arm to the manual setting on release of the second actuator. The prepositionable shaft is movable only in response to the first actuator.

7 Claims, 6 Drawing Figures

12
10
15
22
20
52
18
14
16
51
62
63

12
10
15
20
51
52
14
62
63

GOVERNOR AND DECELERATOR CONTROL LINKAGE

BACKGROUND OF THE INVENTION

This invention relates to a manually operated control mechanism and is particularly directed toward a device in which a first actuator may be used to preposition a control arm at a desired setting while a second actuator may temporarily reposition the control arm at a different setting without disturbing the setting achieved by the first actuator. The control mechanism includes an anti-creep device so that the selected position of the first actuator is not disturbed by vibration or shocks which might otherwise dislodge the controlled parts from their locked positions.

The invention is particularly applicable to various devices where a manually actuated lever is employed to adjust a mechanical linkage or the like at a predetermined position while retaining the capability to reposition the mechanical linkage temporarily. It is particularly applicable to engine governors and it is shown and described herein as so used for purposes of illustration.

It is conventional practice to employ a governor to maintain a constant engine speed under varying load conditions particularly in heavy earthmoving equipment, where generally a compression type ignition engine is used. Various types of governors used in such applications are generally well-known in the art. A governor representative of the type herein considered is found in U.S. Pat. No. 2,961,229 assigned to the assignee of this invention. Generally, governors of the type herein described utilize a spring loaded device and a control lever to tension the governor spring. Particular tensioning of the governor spring determines the operating speed of the engine. In operation of heavy earthworking equipment it is desirable to position the governor setting at a particular engine speed to produce a particular operating speed over the ground while retaining a capability to slow the engine for brief periods without disturbing the governor setting.

Various schemes have been utilized to accomplish such a constant speed setting, but in most cases the schemes have proved complicated and in some cases cumbersome. In the operation of heavy construction equipment, it is extremely desirable to provide an operating scheme for the vehicle which allows the operator to devote his attention to the job at hand. Thus, simplicity of controls is of great importance. Use of the more complex governor control systems presently available may require diversion of operator attention from the task at hand. Furthermore, these complex systems generally have a high initial cost. Therefore, it is desirable to provide a governor control linkage which is of the simplest design and requires the least amount of operator attention.

SUMMARY OF THE INVENTION

This invention provides a simply operated and easily constructed governor control linkage which permits an operator to manually select a desired engine operating speed with a first actuator and retain this desired operating speed setting under varying operating requirements. A second actuator is provided the operator to decelerate the engine from the preset operating speed for brief periods of time without disturbing the aforedescribed setting. Upon release of the second actuator, the engine speed returns to the preset setting where it will continue to operate until the first actuator is repositioned, or the second actuator is again used to temporarily vary engine speed.

It is an object of this invention to provide a control linkage having a manual actuator which allows an infinitely variable manual setting of a governor control linkage.

It is a further object of this invention to provide a second actuator in the aforedescribed linkage which allows temporary repositioning of the governor control linkage at any intermediate position without disturbing the setting of the first actuator.

It is a further object of this invention to provide a linkage which permits positioning of the governor control linkage as described and insures that vibration or shocks will not dislodge the control parts from their locked positions.

It is still another object of this invention to provide the aforedescribed control system in a simply operated arrangement requiring minimum operator attention.

It is still a further object of this invention to provide the aforedescribed control linkage in an economically manufactured arrangement.

Broadly stated the invention is a control linkage having a housing, with a first shaft rotatably mounted in the housing and a second shaft rotatably mounted in the housing. A coupling means is associated with the housing and associates the first and second shaft one with the other for allowing rotation of the second shaft relative the housing only upon rotation of the first shaft. A first lever means is fixedly associated with the second shaft while a second lever means is rotatably mounted about the second shaft. A resilient means is associated with the second shaft and the first and second lever means for urging the second lever into a predetermined relative position with the first lever means. A third lever means is rotatably mounted about the first shaft. The first lever means is engageable with the second lever means for rotating the second lever means in a first direction relative the second shaft while the third lever means is engagable with the second lever means for rotating the second lever means in the same first direction relative the second shaft against the urging of the resilient means.

These and other objects of the invention will become apparent from a study of the accompanying drawings and the following specification.

DETAILED DESCRIPTION

Figure 1:
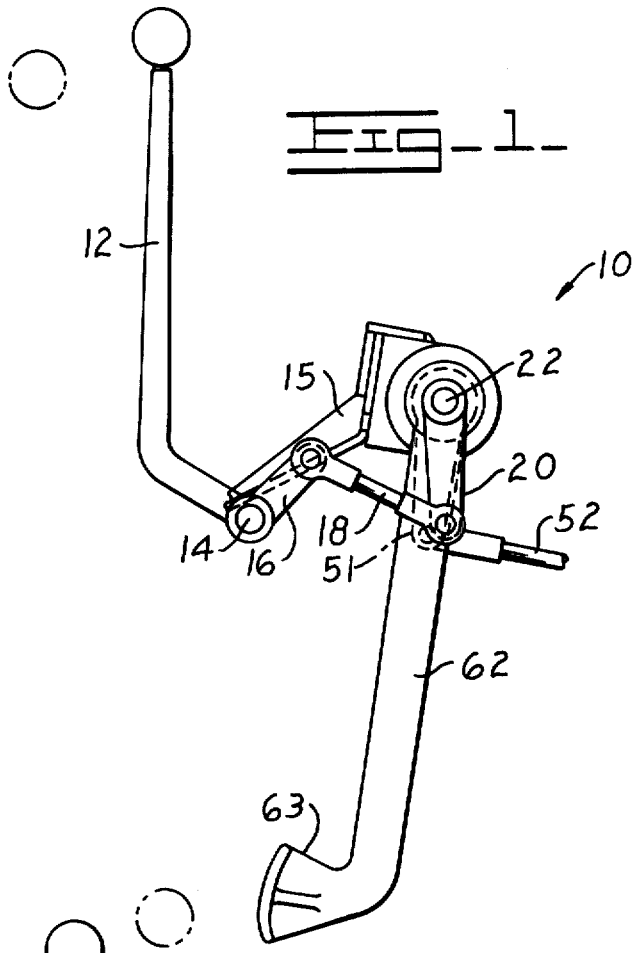
FIG. 1 is an elevation view of the linkage described herein in the first position.
Figure 2:
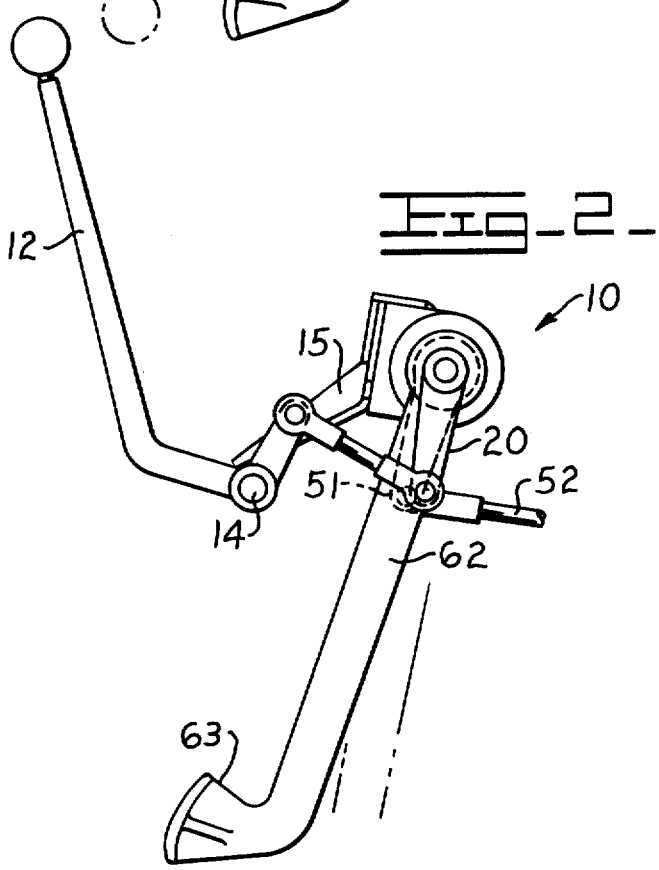
FIG. 2 is an end elevation of the same linkage shown in FIG. 1 in the second position.
Figure 3:
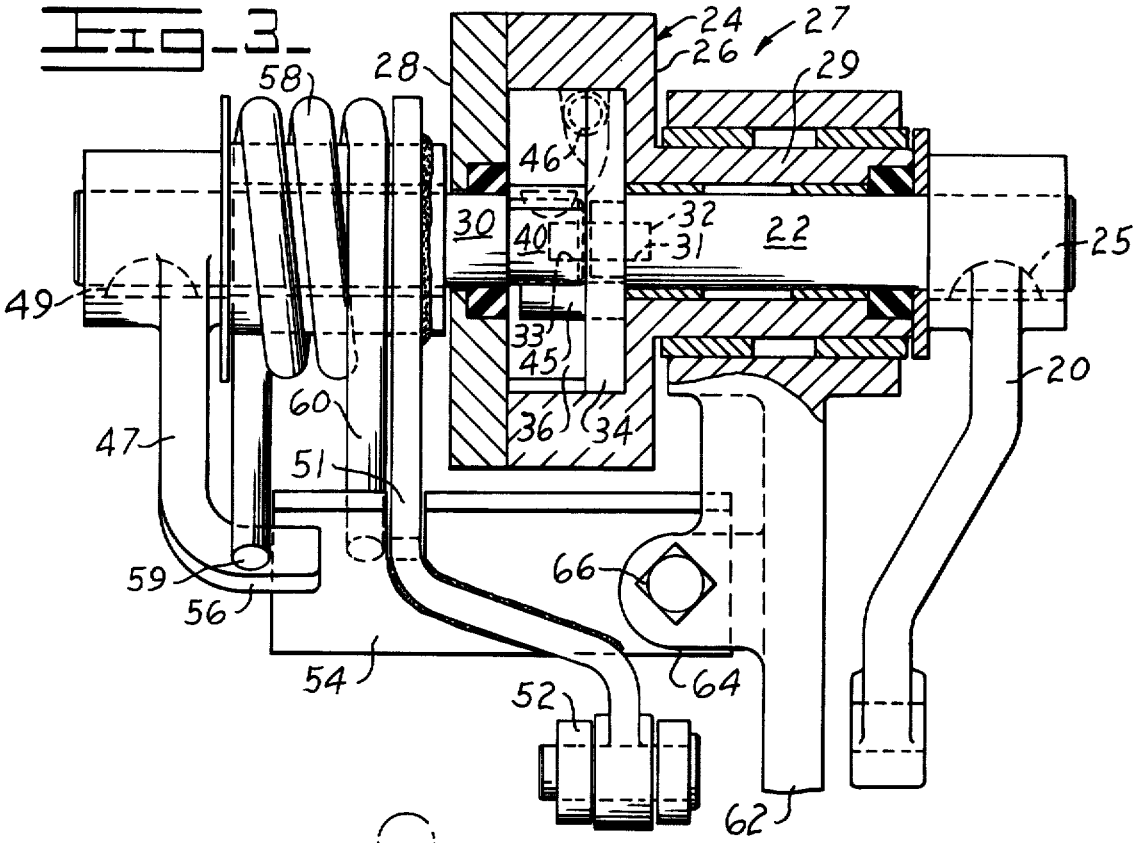
FIG. 3 is a front elevation partly in section of a portion of the linkage shown in FIG. 1 particularly showing the coupling.
Figure 4:
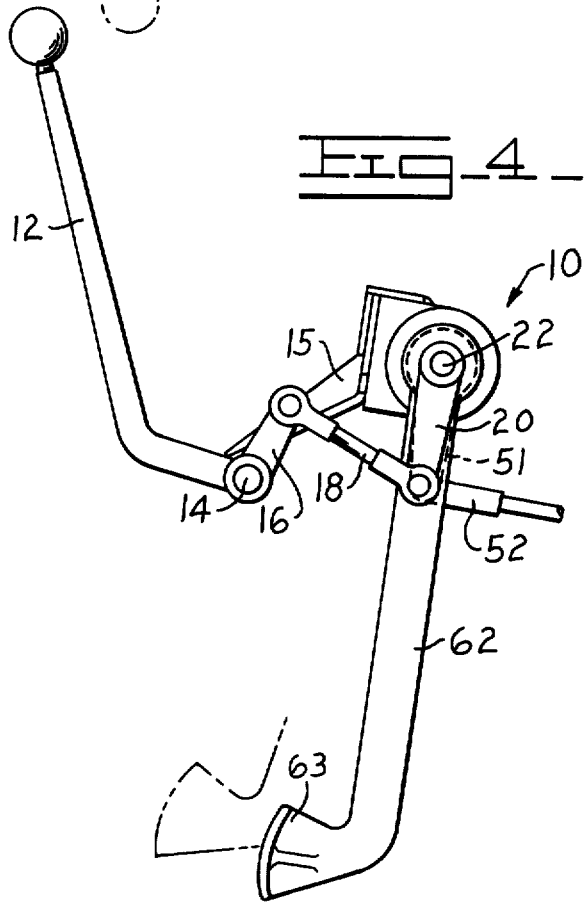
FIG. 4 is a view of the linkage depicted in FIG. 1 with the decelerator pedal in the deceleration position.

Shown in FIG. 1 is a control linkage 10 which is adaptable for use in an engine driven vehicle controlled by an engine governor. The control linkage 10 is particularly applicable for setting an engine governor to operate the engine at a predetermined speed while allowing the operator to temporarily decelerate the engine without influencing the operational setting of the governor. A hand operated first actuator means such as engine governor control lever 12 (hereinafter referred to as control lever 12) is positioned convenient to the operator station to allow the operator to set a predetermined governed engine speed. In the embodiment described herein the control lever 12 is movable from a first position as illustrated in FIG. 1 to a second position as illustrated in FIGS. 2 and 4 to obtain a higher governor setting. Control lever 12 is pivoted at a pin 14 affixed to the control linkage bracket 15 which in turn is affixed to the structure of the vehicle (not shown). Associated with control lever 12 is a crank 16 extending outwardly from pin 14 and movable in response to movement of control lever 12. It should be noted that control lever 12 and crank 16 may be integrally formed as a single part to form a conventional bell crank or they may in turn be separately formed parts and associated upon assembly in a fixed relation. Crank 16 has affixed at the end distal of pin 14, a link 18 which in turn is affixed to a lever 20, the lever 20 being fixedly associated with a first shaft 22 rotatably mounted in housing 24 which in turn is affixed to bracket 15. Referring now to FIG. 3, it can be seen that lever 20 is affixed to first shaft 22 by a conventional key means 25, other means for affixing lever 20 to first shaft 22 are equally applicable. Housing 24 is comprised of a cylindrically shaped first member 26 having a smaller cylindrical extension 29 extending axially therefrom in which first shaft 22 is rotatably mounted. Housing 24 also includes annular disc shaped second member 28 in which a second shaft 30 is rotatably mounted. Second member 28 is affixed to first member 26 to form a cylindrical cavity 35. First shaft 22 and second shaft 30 are axially aligned in an abutting relation interior of cavity 35. The first and second shafts are formed with axial wells 31 and 33 respectively in which a pin member 32 is positioned to insure rotational alignment and a second bearing point for second shaft 30.

Figure 6:
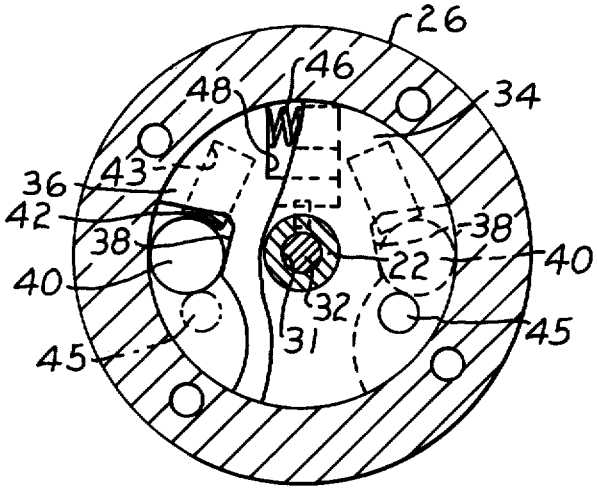
FIG. 6 is a sectional view taken at line VI—VI of FIG. 3.

A plate 34, which forms a portion of a coupling means 27 for rotatively associating first shaft 22 with second shaft 30, is disposed within cavity 35 and is secured to the inner end of shaft 22 for rotative movement therewith. A locking member 36 forming a second portion of coupling means 27 is also disposed within cavity 35 in a face to face relationship with plate 34. Locking member 36 is fixed to the inner end of second shaft 30 for rotative movement therewith and is provided with a pair of cam surfaces 38. As shown in FIG. 6, a pair of wedging members 40 are carried within the space defined by cam surfaces 38 and the inner wall of the cylindrical shaped first member 26. While the wedging members 40 are shown as rollers, the shape is not essential to the function they perform and balls or wedging means of other configurations may be used as desired. The wedging means are jammed into the space between the cam surfaces and the inner wall of the first member to prevent relative movement between these parts in either direction. The wedging members are normally held in their jammed position by means of springs 42 carried in recesses 43 formed in locking member 36. With this arrangement, the wedging action of each of the wedging members will prevent relative movement in one direction between the cylindrical surface and the cam surface with which it engages but will permit movement in the opposite direction. With two wedging members arranged in the manner shown, relative movement in either direction is prevented.

The wedging members 40 are unlocked by means of pins 45 carried by plate 34. The pins 45 project into the space between the locking member 36 and the inner wall of first member 26 so that upon movement of first shaft 22 by actuation of lever 20 one of the pins engages one of the wedging members to dislodge it from its jammed position. Further movement of lever 20 by control lever 12 causes compression of spring 42 associated with that locking means and continued movement of the lever affects rotation of the locking member 36 with relation to the housing. This rotative movement is transmitted through second shaft 30 to a first lever means such as lever 47 affixed thereto. When movement of the lever 20 is stopped, the spring 42 returns the wedging member 40 into its normal jammed position and the parts are again locked against relative rotation.

During operation, machinery vibration or in the case of an engine installation, engine vibration may cause the lever 20 to creep. This circumferential movement of the lever 20 causes rotation of the associated first shaft 22, plate 34 and unlocking pins 45. When one of the pins 45 is vibrated into contact with the corresponding wedging member 40, the wedging member is urged toward the unlocked position with the result that locking member 36 and the associated parts are allowed to move. This movement may cause udesirable fluctuations in the speed of the machinery being governed due to the variations and tensions of springs interconnecting this device with an engine governor. In order to prevent any tendency of the control to creep due to oscillatory vibrations, a dampening member 46 is positioned within a recess 48 formed in abutting faces of plate 34 and locking member 36. As shown in FIG. 6, the ends of dampening member 46 overlap the plate and the locking member directly and resiliently oppose any relative movement induced by vibration. The force of the dampening member is easily overcome when the lever 20 is actuated.

Referring now to FIG. 3, lever 47 is affixed to shaft 30 by appropriate means such as a key 49 insuring rotation of lever 47 upon rotation of shaft 30. Rotatably mounted about shaft 30 is a second lever means such as a second lever 51 which is adapted to be linked to a machine control such as an engine governor (not shown) through link means such as a link 52. Second lever 51 has integrally formed therewith a plate member 54 which extends transversely of the lever in a generally parallel arrangement with the first shaft 22 and a second shaft 30, while first lever 47 is formed with a lateral extension 56 engageable with plate 54. Resilient torsion means such as helical spring 58 is positioned relative shaft 30 and plate 54 so that one end 59 is biased against lateral extension 56 while the other opposite end 60 is biased against plate member 54. The biasing and load on spring 58 is sufficient to hold lateral extension 56 in engagement with plate 54, thus allowing the first lever and the second lever to rotate together.

Rotatably mounted about shaft 22 and in the embodiment depicted in FIG. 3 about the cylindrical extension 29 of first member 26 is a third lever means such as third lever 62 which terminates in a second actuator such as pedal 63 distal of the housing 26. Third lever 62 is formed with a lateral extension 64 which is engageable with plate member 54. In this embodiment, lateral extension 64 is formed with a threaded bore 65 in which a bolt 66 may be threadably engaged to adjustably position lever 62 relative plate 54.

Figure 5:
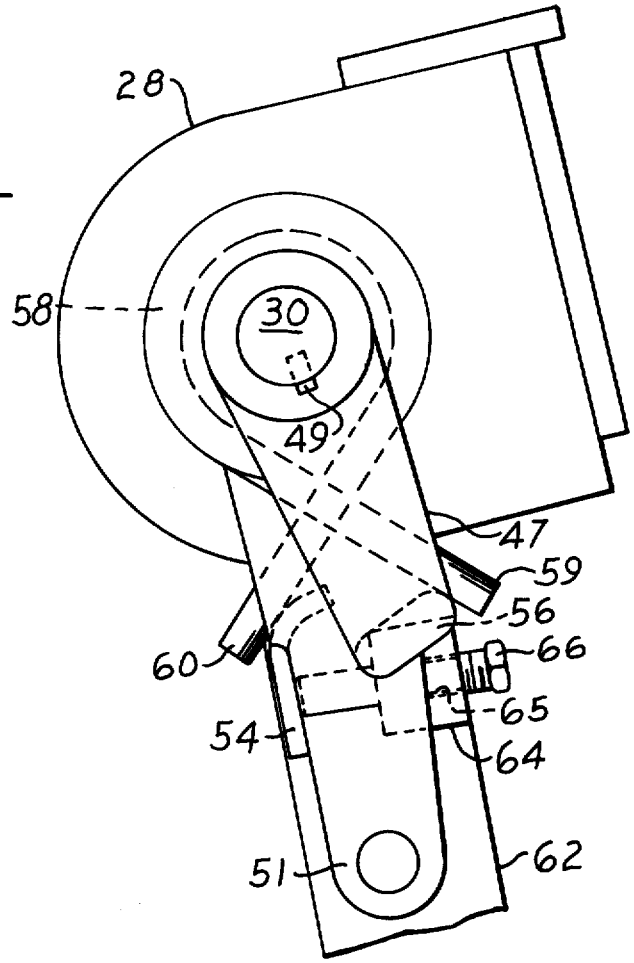
FIG. 5 is an end elevation view taken at the line V—V in FIG. 3.

Referring now to FIG. 1, control lever 12 and pedal 63 are shown in their first positions relative bracket 15 while in FIG. 2 the control lever and pedal have been moved to second positions relative bracket 15. Assuming the first position indicated in FIG. 1 is the idle position and the second position shown in FIG. 2 is the full speed position, then with control lever 12 in the second position pedal 63 is available to decelerate the engine without disturbing the position of control lever 12 and second shaft 30 due to coupling means 27. Coupling means 27 interconnecting first shaft 22 and second shaft 30, insures that the second shaft is rotatable only upon rotation of the first shaft. Further, it can be seen in FIG. 2 that second lever 51, which is resiliently biased to first lever 47 and thus follows the motion of second shaft 30, moves link 52 leftwardly, as seen in FIG. 2 to adjust the setting of a control such as an engine governor. It should be pointed out that in movement of second lever 51 from a first position shown in FIG. 1 to the second position shown in FIG. 2, third lever 62 because of the lateral extension 64 and bolt means 66 follows the motion of second lever 51. Referring to FIG. 4 pedal 63 is shown returned to its first or idle position as indicated in FIG. 1 while control lever 12 and second lever 51 are in the second position or full speed position. It is pointed out that reference to control lever 12 is utilized for convenience in orienting lever 20, movement of control lever 12 will of course move lever 20 from the first to the second position as indicated in FIGS. 1 and 2. Referring now to FIG. 5, lever 62 which serves as the supporting member for pedal 63 and lever 51 are shown in the first position as indicated in FIG. 4 while the remainder of the control device is shown in the second position. Particularly, lever 47 which is integrally fixed with shaft 30 is shown in its second position. It can be seen in FIG. 5 that plate 54 is no longer in engagement with lateral extension 56 thus the spring 58 has been loaded by depressing pedal 62 separating the first end 59 from the second end 60 of spring 58. Depression of pedal 63 has carried plate member 54 and the integrally fixed lever 51 in a clockwise direction in FIG. 5 (counterclockwise in FIG. 4). This movement may be used to "decelerate" a governor affixed thereto by link 52. Release of pedal 3 will return both pedal 63 and lever 51 to the second position as indicated in FIG. 2. Return of lever 51 to the second position returns the engine control or governor to the condition set by control lever 12 before depression of pedal 63. Thus it can be seen that temporary deceleration of an engine through the governor may occur without disturbing the setting of the engine governor control lever.

Although this invention has been described with particular reference to the setting of an engine governor, it is equally applicable to any other device which requires a particular setting and a means for temporarily changing that setting.

What is claimed is:

1. An engine control linkage comprising:

a housing;

a first shaft rotatably mounted in the housing;

a second shaft rotatably mounted in the housing;

coupling means associated with the housing and associating the first shaft with the second shaft for allowing rotation of the second shaft relative the housing only upon rotation of the first shaft;

first lever means fixedly associated with the second shaft for rotation therewith;

second lever means rotatably mounted about the second shaft;

third lever means rotatably mounted about the first shaft;

said first and third lever means each engageable with the second lever means for rotating said second lever means in a first rotative direction relative the second shaft; and resilient means associated with the second shaft and the first and second lever means for urging the second lever means in a second rotative direction to engage the first lever means in a predetermined position relative the first lever means.

2. The control linkage as set forth in claim 1 further comprising a fourth lever means fixedly associated with the first shaft for rotating the first shaft.

3. The control linkage as set forth in claim 2 further comprising adjustable engagement means integrally formed with the third lever means for adjustably positioning the third lever means relative the second lever means.

4. The control linkage as set forth in claim 3 wherein the second lever means comprises a lever arm rotatably mounted about the second shaft and a plate integrally formed with the second lever to allow the engagement of the plate with the first lever means and the third lever means.

5. The control linkage as set forth in claim 4 wherein the resilient means comprises a helical torsion spring having a first end engaging the first lever means and having a second end engaging the plate so that the plate is urged relatively toward the first lever means.

6. The control linkage as set forth in claim 5 wherein the coupling means comprises a plate member affixed to the first shaft for rotation therewith, a locking member fixed to the second shaft for rotation therewith and in face to face relation with the plate member, said palte member and said locking member rotatable in the housing, the locking member defining a first cam surface and a second cam surface;

the coupling further comprising a first wedging member and a second wedging member positioned between the first cam surface and the second cam surface, respectively, and the housing;

a first resilient means and a second resilient means urging the first wedging member and the second wedging member respectively into locking engagement with the cam surface and the housing;

first pin means and a second pin means each respectively engaged with the plate member and rotatable therewith;

the first pin means for disengaging the first wedging member on rotation of the first shaft in a first direction, and the second pin for disengaging the second wedging member upon rotation of the first shaft in the second direction.

7. The control linkage as set forth in claim 6 further comprising a dampening member engaged with the plate and the locking member to dampen out vibratory motion between the plate and the locking member.

* * * * *